United States Patent [19]

Shindelka

[11] 4,280,644

[45] Jul. 28, 1981

[54] PROTECTIVE GUN SLING

[76] Inventor: Frank A. Shindelka, 24 Glenbrook Blvd., Sherwood Park, Alberta, Canada, T8A 2Z2

[21] Appl. No.: 156,073

[22] Filed: Jun. 3, 1980

[30] Foreign Application Priority Data

Nov. 28, 1979 [CA] Canada ..... 340939

[51] Int. Cl.[3] ..... F41C 33/00

[52] U.S. Cl. ..... 224/149

[58] Field of Search ..... 224/149, 150, 913, 49

[56] References Cited

U.S. PATENT DOCUMENTS

| | | | |
|---|---|---|---|
| 2,277,976 | 3/1942 | Helmenstine | 224/49 X |
| 2,576,559 | 11/1951 | Bennek | 224/149 |
| 2,812,123 | 11/1957 | Girton | 224/49 X |
| 2,884,172 | 4/1959 | Kubo | 224/149 |
| 3,182,871 | 5/1965 | Gossler | 224/149 |

*Primary Examiner*—Steven M. Pollard

*Attorney, Agent, or Firm*—George H. Dunsmuir

[57] ABSTRACT

The invention relates generally to carrying slings adapted for temporary attachment to, for example, rifles and shotguns. More particularly, the sling, according to the present invention, consists in a single, intergrally molded element of flexible, resilient material having end portions adapted to engage respectively, the stock and the nozzle of the firearm, and to be maintained in elastic engagement with the firearm by means of a common strap member.

1 Claim, 3 Drawing Figures

PROTECTIVE GUN SLING

BACKGROUND OF THE INVENTION

The invention relates generally to slings for firearms such as rifles or shotguns, but more particularly to a sling which, in addition to acting as a temporary carrying device for the firearm, serves to protect the nozzle from ingress of foreign matter, and the stock, during transportation.

SUMMARY OF THE INVENTION

The sling, according to the invention, is comprised of a single, integrally molded element of flexible resilient material having end portions adapted to engage respectively, the stock and the nozzle of a firearm, and to be maintained in elastic engagement with the firearm by means of a common strap member.

BRIEF DESCRIPTION OF THE DRAWINGS

The invention will now be described by way of example only, reference being made to the accompanying drawings in which.

DESCRIPTION OF THE PREFERRED EMBODIMENT(S)

Referring specifically to the drawings, the sling can be seen to consist in a one-piece integrally molded element, preferably manufactured from good quality rubber. For ease of description, the sling 1 includes a butt section 6, a nozzle section 5, and an integral interconnecting strap 3.

Figure 2:
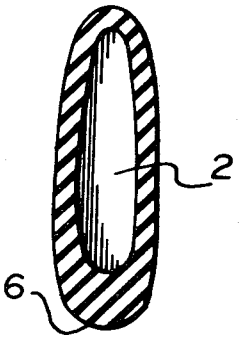
FIG. 2 is a sectional view, taken on line 2—2 of FIG. 1, through the butt portion of the sling.

Butt section 6, as can be seen from FIG. 2, is provided with a cavity 2, the size and depth of which cavity being chosen such that it will, by virtue of the inherent elasticity of the sling material, conform to any size and shape of stock.

Figure 3:
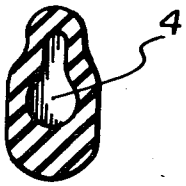
FIG. 3 is a sectional view, taken on line 3—3 of FIG. 1, through the nozzle portion of the sling.

Nozzle section 5, as can be seen from FIG. 3, is also provided with a cavity, the profile of which is such that it accepts the nozzle of the firearm. Since the present invention contemplates the protection of any foresight in the embodiment disclosed, the cavity 4 is of such length and profile as to extend over, and protectively encompass such a sight.

Figure 1:
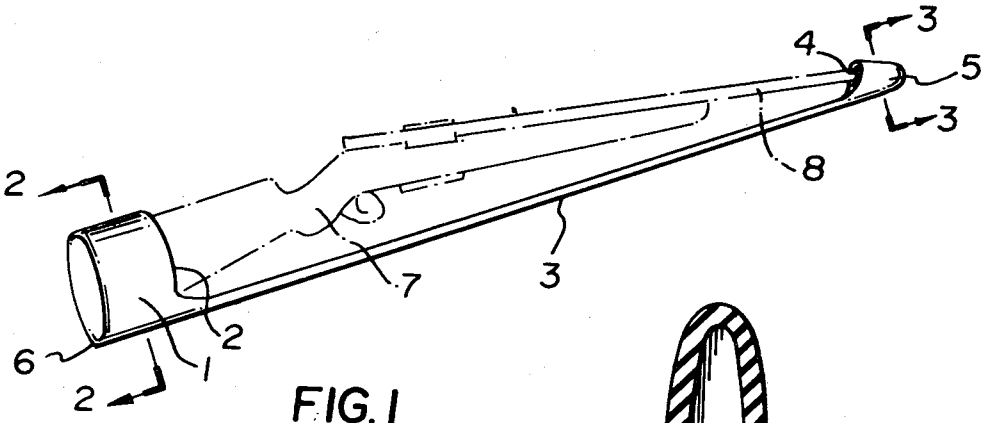
FIG. 1 is a perspective view of the sling constructed in accordance with the invention showing the manner of attachment to a firearm.

As will be appreciated from FIG. 1, the butt and nozzle portions of the sling are maintained in elastic engagement with the firearm by means of strap 3. Due to elasticity of the material of the sling, the manner of operation should be readily apparent, the tension of strap 3 will be sufficient to maintain the butt section and the nozzle section of the sling on the gun when handled.

The sling, according to the invention is, as would be appreciated, taken off to fire the weapon. The butt section 6 covers the butt end of the stock of the firearm and may be utilized as a cushion to the shoulder when the weapon is discharged.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example equivalent elements may be substituted for those illustrated and described herein, parts may be used independently of the use of other features, all as will be apparent to one skilled in the art after having the benefits of the description of the invention.

What I claim is:

1. A gun sling comprised of a single integrally molded element of flexible material, said element comprising:

(a) a front end portion having an aperture extending partway therethrough of a size adapted to receive and fit over the muzzle of a firearm;

(b) a second end portion having an aperture extending partway therethrough of a size adapted to receive and fit over at least part of the butt of a firearm; and (c) strap means interconnecting each said end portion so as to maintain, when in use, said end portions in elastic engagement with said firearm.

* * * * *